US012371957B2

(12) United States Patent
Dufour et al.

(10) Patent No.: US 12,371,957 B2
(45) Date of Patent: Jul. 29, 2025

(54) TRIGGER SYSTEM FOR A DOWNHOLE TOOL

(71) Applicant: Schlumberger Technology Corporation, Sugar Land, TX (US)

(72) Inventors: Yann Dufour, Houston, TX (US); Oguzhan Guven, Bellaire, TX (US); Kaiyang Kevin Liew, Houston, TX (US); Frederic Levesque, Sugar Land, TX (US); Maria-Fernanda Tafur, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/553,884

(22) PCT Filed: Apr. 1, 2022

(86) PCT No.: PCT/US2022/022992
§ 371 (c)(1),
(2) Date: Oct. 4, 2023

(87) PCT Pub. No.: WO2022/216535
PCT Pub. Date: Oct. 13, 2022

(65) Prior Publication Data

US 2024/0183237 A1 Jun. 6, 2024

Related U.S. Application Data

(60) Provisional application No. 63/171,296, filed on Apr. 6, 2021.

(51) Int. Cl.

| | |
|---|---|
| ***E21B 23/04*** | (2006.01) |
| ***E21B 23/06*** | (2006.01) |
| ***E21B 41/00*** | (2006.01) |

(52) U.S. Cl.
CPC ..... *E21B 23/0412* (2020.05); *E21B 23/042* (2020.05); *E21B 23/06* (2013.01); *E21B 41/00* (2013.01); *E21B 2200/04* (2020.05)

(58) Field of Classification Search
CPC . E21B 23/0412; E21B 23/042; E21B 23/0421
See application file for complete search history.

(56) References Cited

U.S. PATENT DOCUMENTS 2,918,125 A * 12/1959 Sweetman ..... E21B 29/02 148/201
3,819,282 A 6/1974 Schultz
(Continued)

FOREIGN PATENT DOCUMENTS

CA 2887636 C 12/2020
CN 107060720 A 8/2017
(Continued)

OTHER PUBLICATIONS

International Search Report and Written Opinion issued in the PCT Application PCT/US2020/029097 dated Jul. 27, 2021 (14 pages).
(Continued)

*Primary Examiner* — Robert E Fuller
(74) *Attorney, Agent, or Firm* — Jeffrey D. Frantz

(57) ABSTRACT

A trigger system for use with a downhole tool. The trigger system may include a first housing forming a first pressure chamber at a first pressure and including a membrane positioned in a wall of the first housing, a piston disposed at least partially within the first housing and shiftable from an initial position to an actuated position to actuate the downhole tool, and a trigger. The trigger may include a second housing sealed against the first housing proximate the membrane to form a second pressure chamber at a second pressure and a rupturing member positioned within the second housing and operable to pierce the membrane to balance the pressures within the first housing and the second
(Continued)

housing and shift the piston from the initial position to the actuated position.

20 Claims, 5 Drawing Sheets

(56) References Cited

U.S. PATENT DOCUMENTS 4,031,826 A 6/1977 Gemmell et al.
4,041,865 A 8/1977 Evans et al.
4,620,591 A * 11/1986 Terrell ..... E21B 29/02 166/212
5,191,937 A 3/1993 Cook, Sr.
5,273,116 A 12/1993 Ross
5,392,856 A 2/1995 Broussard, Jr. et al.
5,435,390 A 7/1995 Baugh et al.
5,558,153 A 9/1996 Holcombe et al.
5,911,277 A 6/1999 Hromas et al.
6,021,095 A 2/2000 Tubel et al.
6,172,614 B1 1/2001 Robison et al.
6,450,258 B2 9/2002 Green et al.
6,450,263 B1 9/2002 Schwendemann
6,925,807 B2 8/2005 Jones et al.
6,945,331 B2 9/2005 Patel
7,025,130 B2 4/2006 Bailey et al.
7,108,073 B2 9/2006 Patel
7,237,616 B2 7/2007 Patel
7,336,474 B2 2/2008 Lerche et al.
7,337,850 B2 3/2008 Contant
7,347,272 B2 3/2008 Patel et al.
7,367,405 B2 5/2008 Murray
7,461,580 B2 12/2008 Bell et al.
7,597,139 B2 10/2009 Moyes
7,597,151 B2 10/2009 Curtis et al.
7,604,062 B2 10/2009 Murray
7,610,958 B2 11/2009 Moyes
7,642,926 B2 1/2010 Liberale et al.
7,673,680 B2 3/2010 Buyers et al.
7,681,651 B2 3/2010 Loughlin
7,681,652 B2 3/2010 Gaudette et al.
7,748,462 B2 7/2010 Reid
7,891,434 B2 2/2011 Gaudette et al.
7,963,322 B2 6/2011 Richard et al.
8,164,980 B2 4/2012 Sullivan et al.
8,191,629 B2 6/2012 Gordon et al.
8,469,106 B2 6/2013 Caminari et al.
8,499,826 B2 8/2013 Hillis et al.
8,517,113 B2 8/2013 Sheffield
8,536,528 B2 9/2013 DiFoggio
8,602,105 B2 12/2013 Sinclair
8,616,276 B2 12/2013 Tips et al.
8,684,093 B2 4/2014 Segura et al.
8,689,887 B2 4/2014 Ross
8,714,005 B2 5/2014 Vetter
8,733,448 B2 5/2014 Skinner et al.
8,776,890 B2 7/2014 Basmajian et al.
8,851,160 B2 10/2014 Stolboushkin
8,851,161 B2 10/2014 Scott et al.
8,893,798 B2 11/2014 Hayter et al.
8,943,884 B2 2/2015 Kumar
8,991,496 B2 3/2015 Bishop
9,022,108 B2 5/2015 Chatelet et al.
9,103,197 B2 8/2015 Purkis
9,121,250 B2 9/2015 Godfrey et al.
9,145,980 B2 9/2015 Lauderdale
9,163,488 B2 10/2015 Tips et al.
9,273,549 B2 3/2016 Walton et al.
9,309,745 B2 4/2016 Patel
9,316,091 B2 4/2016 Symms
9,353,600 B2 5/2016 Cong et al.
9,359,865 B2 6/2016 Mailand
9,404,340 B2 8/2016 Wood et al.
9,428,999 B2 8/2016 Tips et al.
9,598,933 B2 3/2017 Inglis
9,631,445 B2 4/2017 Hradecky
9,664,004 B2 5/2017 Martinez et al.
9,664,007 B2 5/2017 Lopez et al.
9,670,941 B2 6/2017 Dalton et al.
9,745,823 B2 8/2017 Wood et al.
9,777,557 B2 10/2017 Richard et al.
9,845,661 B2 12/2017 Williamson et al.
9,856,714 B2 1/2018 Giroux
9,869,153 B2 1/2018 Moreno et al.
9,903,192 B2 2/2018 Entchev et al.
9,903,971 B2 2/2018 Swett
9,926,769 B2 3/2018 Wood et al.
9,958,838 B2 5/2018 Zacharko et al.
10,066,467 B2 9/2018 Getzlaf et al.
10,125,572 B2 11/2018 Wood et al.
10,145,200 B2 12/2018 McKenzie
10,174,586 B2 1/2019 Symms
10,221,680 B2 3/2019 August et al.
10,233,725 B2 3/2019 Provost
10,253,594 B2 4/2019 Wakefield et al.
10,287,851 B2 5/2019 El Mallawany
10,301,908 B2 5/2019 Wakefield et al.
10,309,174 B2 6/2019 Burgos et al.
10,352,117 B2 7/2019 OConnor
10,365,079 B2 7/2019 Harrington et al.
10,408,025 B2 9/2019 Harrington et al.
10,408,048 B2 9/2019 Roberson et al.
10,480,283 B2 11/2019 Joseph et al.
10,502,024 B2 12/2019 Wang et al.
10,533,387 B2 1/2020 Dirksen et al.
10,563,481 B2 2/2020 Richards
10,584,560 B2 3/2020 Alley
10,584,563 B2 3/2020 Richards et al.
10,619,474 B2 4/2020 Ufondu et al.
10,689,948 B2 6/2020 Hardesty et al.
10,697,256 B2 6/2020 Wiedecke et al.
10,781,677 B2 9/2020 Mlcak
10,794,157 B2 10/2020 Kohn et al.
2004/0020643 A1 2/2004 Thomeer et al.
2007/0144731 A1 6/2007 Murray et al.
2008/0066931 A1 3/2008 Xu
2011/0056679 A1 3/2011 Rytlewski
2011/0146984 A1 6/2011 Krush
2011/0168403 A1 7/2011 Patel
2011/0265987 A1 11/2011 Wright et al.
2012/0267119 A1 10/2012 Patel
2012/0285702 A1 11/2012 Rytlewski
2013/0306374 A1 11/2013 Wood
2014/0246236 A1 9/2014 Radford
2017/0275984 A1 9/2017 Wang et al.
2019/0055816 A1 2/2019 Johnson et al.
2019/0249520 A1* 8/2019 Merron ..... E21B 47/10
2019/0376368 A1 12/2019 Miller et al.
2020/0072045 A1 3/2020 Bramlage et al.
2020/0115992 A1 4/2020 Wang et al.

FOREIGN PATENT DOCUMENTS

EP 3012400 B1 4/2020
GB 2280013 A 1/1995
WO 2006000799 A2 1/2006
WO 2007103680 A1 9/2007
WO 2008060893 A2 5/2008
WO 2009105128 A1 8/2009
WO 2009154817 A2 12/2009
WO 2011119448 A2 9/2011
WO 2014210367 A2 12/2014
WO 2017213885 A1 12/2017
WO 2018118921 A1 6/2018
WO 2018132666 A1 7/2018
WO 2019132969 A1 7/2019
WO 2019183316 A1 9/2019
WO 2020219435 A1 10/2020
WO 2021167917 A1 8/2021
WO 2021168032 A1 8/2021

(56) References Cited

FOREIGN PATENT DOCUMENTS

| | | | |
|---|---|---|---|
| WO | 2022010993 | A1 | 1/2022 |
| WO | 2022204284 | A1 | 10/2022 |

OTHER PUBLICATIONS

International Preliminary Report on Patentability issued in the PCT Application PCT/US2020/029097 dated Oct. 4, 2021 (11 pages).
International Search Report and Written Opinion issued in the PCT Application PCT/US2022/021548 dated Jun. 23, 2022 (10 pages).
International Search Report and Written Opinion issued in the PCT Application PCT/US2022/022992 dated Jul. 8, 2022 (10 pages).

* cited by examiner

TRIGGER SYSTEM FOR A DOWNHOLE TOOL

CROSS-REFERENCE TO RELATED APPLICATIONS

The present application is a National Stage Entry of International Application No. PCT/US2022/022992, filed Apr. 1, 2022, which claims priority benefit of U.S. Provisional Application No. 63/171,296, filed Apr. 6, 2021, the entirety of which is incorporated by reference herein and should be considered part of this specification.

BACKGROUND

An isolation valve is a device that provides isolation to a reservoir. Specifically, a formation isolation valve is downhole completion equipment that is used to provide two-way isolation from the formation. This double isolation allows the performance of completion operations without placing a column of heavy fluid in the wellbore to prevent the production of reservoir fluids.

Although the main purpose of a formation isolation valve is formation isolation, the versatility of the formation isolation valve may be seen in a broad range of applications including prevention of fluid loss, packer setting, and lateral isolation. An isolation valve, such as a formation isolation valve, may include at least a trigger system and an actuator to remotely change the state of the isolation valve.

SUMMARY

According to one or more embodiments of the present disclosure, a trigger system for use with a downhole tool includes a first housing, a piston, and a first trigger. The housing forms a first pressure chamber at a first pressure and includes a first membrane positioned in a wall of the first housing. The piston is disposed at least partially within the first housing, the piston shiftable from an initial position to an actuated position to actuate the downhole tool. The trigger includes a second housing and a first rupturing member. The second housing is sealed against the first housing proximate the first membrane to form a second pressure chamber at a second pressure. The first rupturing member is positioned within the second housing and operable to pierce the first membrane to balance the pressures within the first housing and the second housing and shift the piston from the initial position to the actuated position.

According to one or more embodiments of the present disclosure, a completion system includes a well string, a downhole tool operatively coupled to the well string, and a trigger system operatively coupled to the downhole tool. The trigger system includes a first housing, a piston, and a first trigger. The housing forms a first pressure chamber at a first pressure and includes a first membrane positioned in a wall of the first housing. The piston is disposed at least partially within the first housing, the piston shiftable from an initial position to an actuated position to actuate the downhole tool. The trigger includes a second housing and a first rupturing member. The second housing is sealed against the first housing proximate the first membrane to form a second pressure chamber at a second pressure. The first rupturing member is positioned within the second housing and operable to pierce the first membrane to balance the pressures within the first housing and the second housing and shift the piston from the initial position to the actuated position.

According to one or more embodiments of the present disclosure, a method of producing a well includes running a well string comprising a downhole tool and a trigger system into the well. The method also includes rupturing a membrane separating a first housing of the trigger system at a first pressure and a second housing of the trigger system at a second pressure to balance the pressures in the first housing and the second housing to shift a piston of the trigger system from an initial position to an actuated position. The method further includes actuating the downhole tool via the shifted piston.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
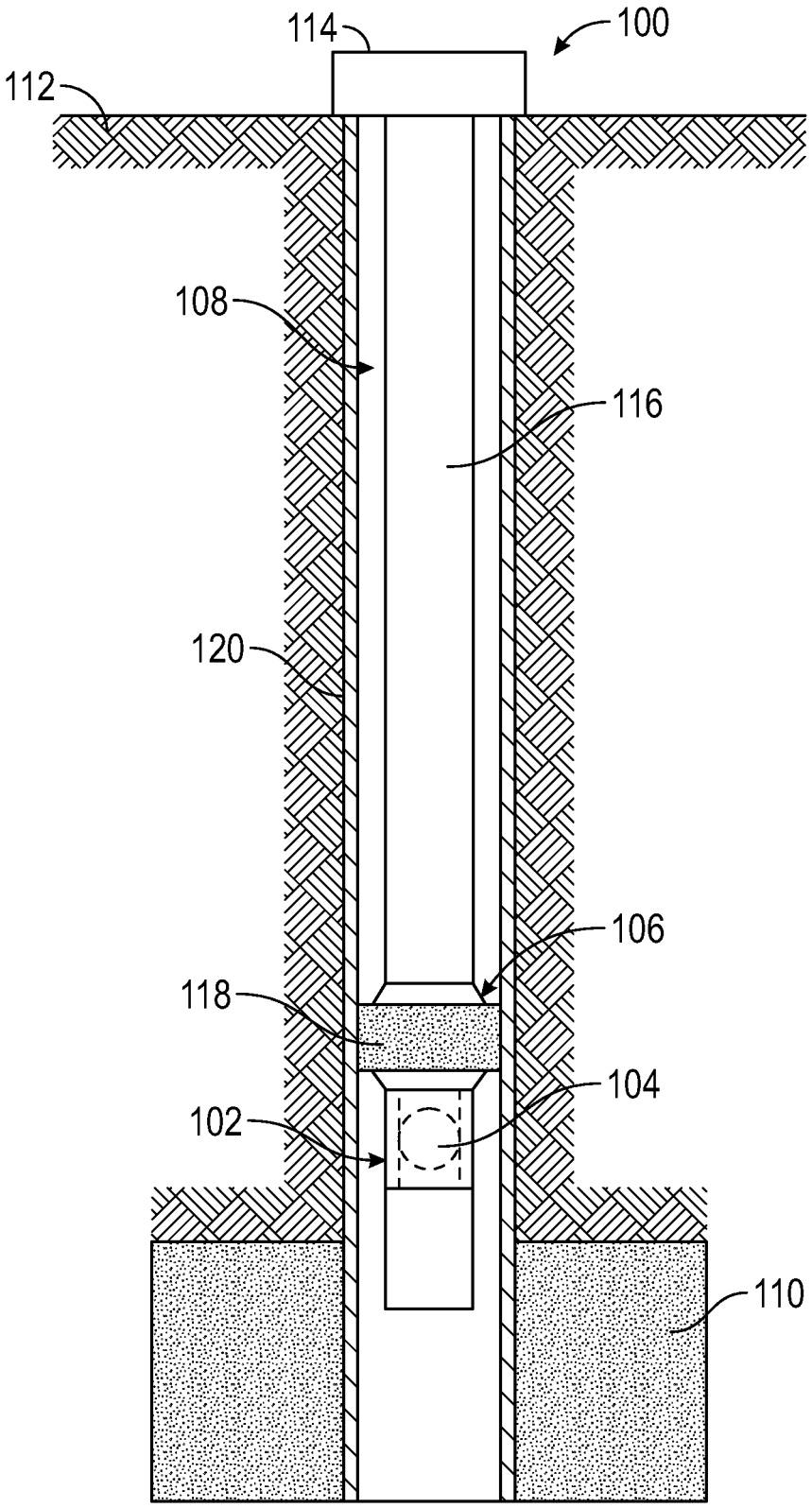
FIG. 1 shows a cross-sectional view of an example of a well string deployed in a wellbore and combined with an isolation valve, according to one or more embodiments of the present disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims, the terms "connect," "connection," "connected," "in connection with," and "connecting," are used to mean "in direct connection with," in connection with via one or more elements." The terms "couple," "coupled," "coupled with," "coupled together," and "coupling" are used to mean "directly coupled together," or "coupled together via one or more elements." The term "set" is used to mean setting "one element" or "more than one element." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure. Commonly, these terms relate to a reference point at the surface from which drilling operations are initiated as being the top point and the total depth being the lowest point, wherein the well (e.g., wellbore, borehole) is vertical, horizontal, or slanted relative to the surface.

The present disclosure generally relates to systems and methods that facilitate actuation of an isolation valve or other downhole device. According to one or more embodiments of the present disclosure, an isolation valve includes an isolation valve member, e.g., a ball valve element, which may be actuated between positions. For example, the isolation valve member may be actuated between closed and open positions by a mechanical section having a shifting linkage.

In one or more embodiments of the present disclosure, actuation of the mechanical section, and thus actuation of the isolation valve member, is achieved by a redundant trigger system controlled according to a signal, which may be applied from the surface or from another suitable location. Indeed, one way to increase the reliability of remote opening of the isolation valve member is to introduce redundancy into the mechanism via the redundant trigger system according to one or more embodiments of the present disclosure. Advantageously, the redundant trigger system according to one or more embodiments of the present disclosure provides two independent and equally reliable remote activation triggers, which may be installed simultaneously in a valve block of the redundant trigger system of the isolation valve. In one or more embodiments of the present disclosure, the first trigger may be a hydraulic trigger, and the second trigger may be an electronic trigger, for example. Other combinations are conceivable, and are within the scope of the present disclosure. For example, both triggers may be hydraulic triggers, or both triggers may be electronic triggers. Alternatively, the triggers may be any type of trigger. Additionally, although the redundant trigger system is described in relation to an isolation valve, the invention is not thereby limited. The redundant trigger may be used to actuate any type of downhole tool, for example, but not limited to, an ball valve, a sleeve valve, a flapper valve, or a packer.

Referring generally to FIG. 1, one example of a generic well system 100 is illustrated as employing an isolation valve system 102 comprising at least one isolation valve 104. Well system 100 may comprise a completion 106 or other downhole equipment that is deployed downhole in a wellbore 108. The isolation valve 104 may be one of a wide variety of components included as downhole equipment 106. Generally, the wellbore 108 is drilled down into or through a formation 110 that may contain desirable fluids, such as hydrocarbon-based fluids. The wellbore 108 extends down from a surface location 112 beneath a wellhead 114 or other surface equipment suitable for the given application.

Depending on the specific well application, e.g., such as a well perforation application, the completion/well equipment 106 is delivered downhole via a suitable well string 116, e.g., a well completion string. However, the well string 116 and the components of completion 106 often vary substantially. In many applications, one or more packers 118 is used to isolate the annulus between downhole equipment 106 and the surrounding wellbore wall, which may be in the form of a liner or casing 120. The isolation valve 104 may be selectively actuated to open or isolate formation 110 with respect to flow of fluid through completion 106.

Figure 2:
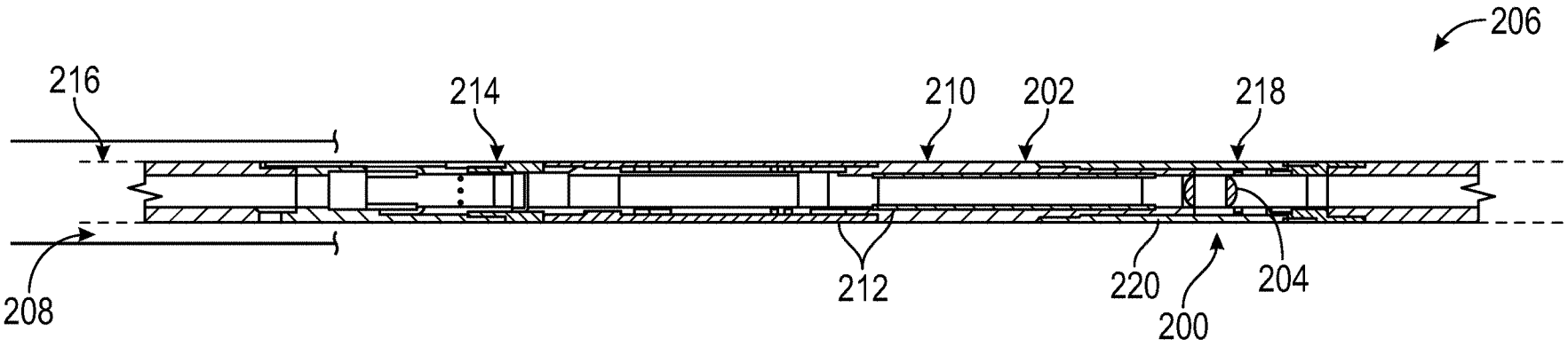
FIG. 2 shows a schematic view of a completion having an isolation valve deployed in a wellbore, according to one or more embodiments of the present disclosure.

Referring now to FIG. 2, an example of a completion 206 is illustrated. The completion 206 may include a well string 216 deployed in a wellbore 208 or other type of borehole. The completion 206 also may include an actuatable device 200, which may be selectively actuated between operational positions in response to a controlled signal. For example, the controlled signal may be supplied from the surface and down through well string 216 to initiate actuation of device 200. Specifically, in one or more embodiments of the present disclosure, the controlled signal may be conveyed through a column of fluid inside the well string 216, for example. In one or more embodiments of the present disclosure, the nature of the controlled signal may be electric, electromagnetic, acoustic, optic, chemical, a series of pressure pulses, a pressure differential, and/or a temperature differential, for example.

Still referring to FIG. 2, the actuatable device 200 according to one or more embodiments of the present disclosure may be part of an isolation valve 202 disposed along the well string 216. For example, the actuatable device 200 may be in the form of a ball valve element 204 or other type of actuatable valve element. According to the illustrated embodiment, the isolation valve 202 may include a ball section 218, which includes the ball valve element 204 rotatably mounted in a corresponding ball section housing 220. In one or more embodiments of the present disclosure, the ball valve element 204 may rotate open or closed with special seals to secure effective isolation along an interior of the well string 216 and to prevent entry of unwanted debris.

Still referring to FIG. 2, the ball valve element 204 (or other actuatable device) may be shifted between operational positions via a mechanical section 210 coupled with the ball section 218. According to one or more embodiments of the present disclosure, the mechanical section 210 may include a mechanical linkage 212 connected to the ball valve element 204 or other actuatable device. According to one or more embodiments of the present disclosure, the mechanical linkage 212 may include a mechanical shifting profile and a position-lock collet, for example. The mechanical section 210 and mechanical linkage 212 are operatively coupled with the trigger system 214, which includes a remote opening mechanism that responds to a controlled signal to cause shifting of, for example, mechanical linkage 212 and ball valve element 204. In one or more embodiments of the present disclosure, the trigger system 214 may be a redundant trigger system as further described below. By way of example, the trigger system 214 may be used to shift the ball valve element 204 from a closed position to an open position via the controlled signal applied from the surface or other suitable location, according to one or more embodiments of the present disclosure.

Figure 3:
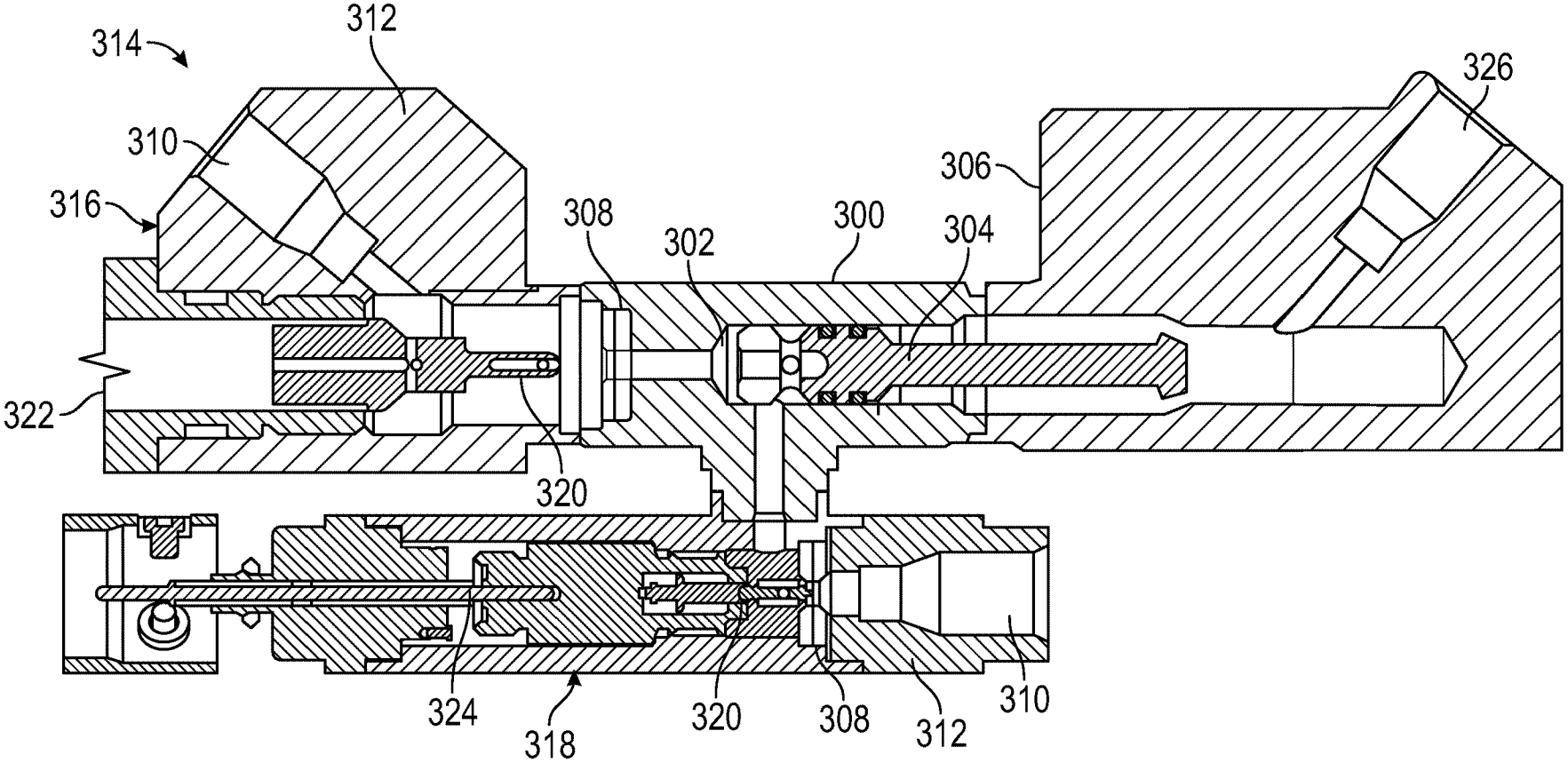
FIG. 3 shows a cross-sectional view of a trigger system, according to one or more embodiments of the present disclosure.

Referring now to FIG. 3, FIG. 3 shows a cross-sectional view of a trigger system 314. The trigger system 314 includes a housing 300 forming a pressure chamber 302. A piston 304 is positioned at least partially within the housing 300 and seals against the housing 300, as shown in FIG. 3. The piston 304 may also extend into a downhole tool 306 via a flowpath extending between the housing 300 and the downhole tool 306.

The trigger system 314 also includes one or more membranes 308 that isolate the pressure chamber 302 from additional pressure chambers 310 located within housings 312 of mechanical trigger 316 and the electrical trigger 318, respectively, that are sealed against the housing 300. In one embodiment, the pressures within the pressure chambers 310 of the triggers 316, 318 may be approximately equal and greater than the pressure within the housing 300. In other embodiments, the pressures within the pressure chambers 310 of the triggers 316, 318 may not be equal and/or one or both of the pressures within the pressure chambers 310 of the triggers 316, 318 may be less than the pressure within the housing 300.

Each trigger 316, 318 also includes a rupturing member 320 that extends through the adjacent membrane 308 upon the trigger 316, 318 receiving a control signal from the surface or from another location along a well string. Control signals may actuate each trigger 316, 318 independently or actuate both of the triggers 316, 318 at the same time. In operation, receipt of the control signal by the trigger system 314 may cause a mechanical actuator 322, such as a spring mechanism coupled to the rupturing member 320, to be activated, thereby shifting the rupturing member 320 to puncture the membrane 308. In the case of the electronic trigger 318, the control signal may initiate an electric current an electronic actuator, such as a bridge wire 324 that causes a detonation within the electrical trigger 318. The detonation causes the rupturing member 320 of the electronic trigger 318 to shift and puncture the membrane 308. In other embodiments, alternative types of mechanical and/or electronic actuation may be used to shift a rupturing member 320 to puncture a membrane 308.

Once a membrane 308 is ruptured, the pressures within the housing 300 and the pressure chamber 310 of the respective trigger 316, 318 balance, which causes either an increase or a decrease in the pressure within the housing 300, thereby shifting the piston 304 into an actuated position. The movement of the piston 304, in turn, causes the actuation of the downhole tool 306 either through a mechanical connection or a change in pressure within an actuator chamber 326 of the downhole tool 306.

As a non-limiting example, in the embodiment illustrated in FIG. 3, the pressure within the trigger pressure chambers 310 is greater than the pressure within the housing 300. Rupturing the membrane 308 via either of the triggers 316, 318 causes an increase in the pressure within the housing 300, shifting the piston 304 towards the downhole tool 306. The movement of the piston 304 balances the pressures within the pressure chamber 310, the housing 300, and the actuator chamber 326 of downhole tool 306, which changes the pressure within the actuator chamber 326 of the downhole tool 306, thereby, actuating the downhole tool 306.

Figure 4:
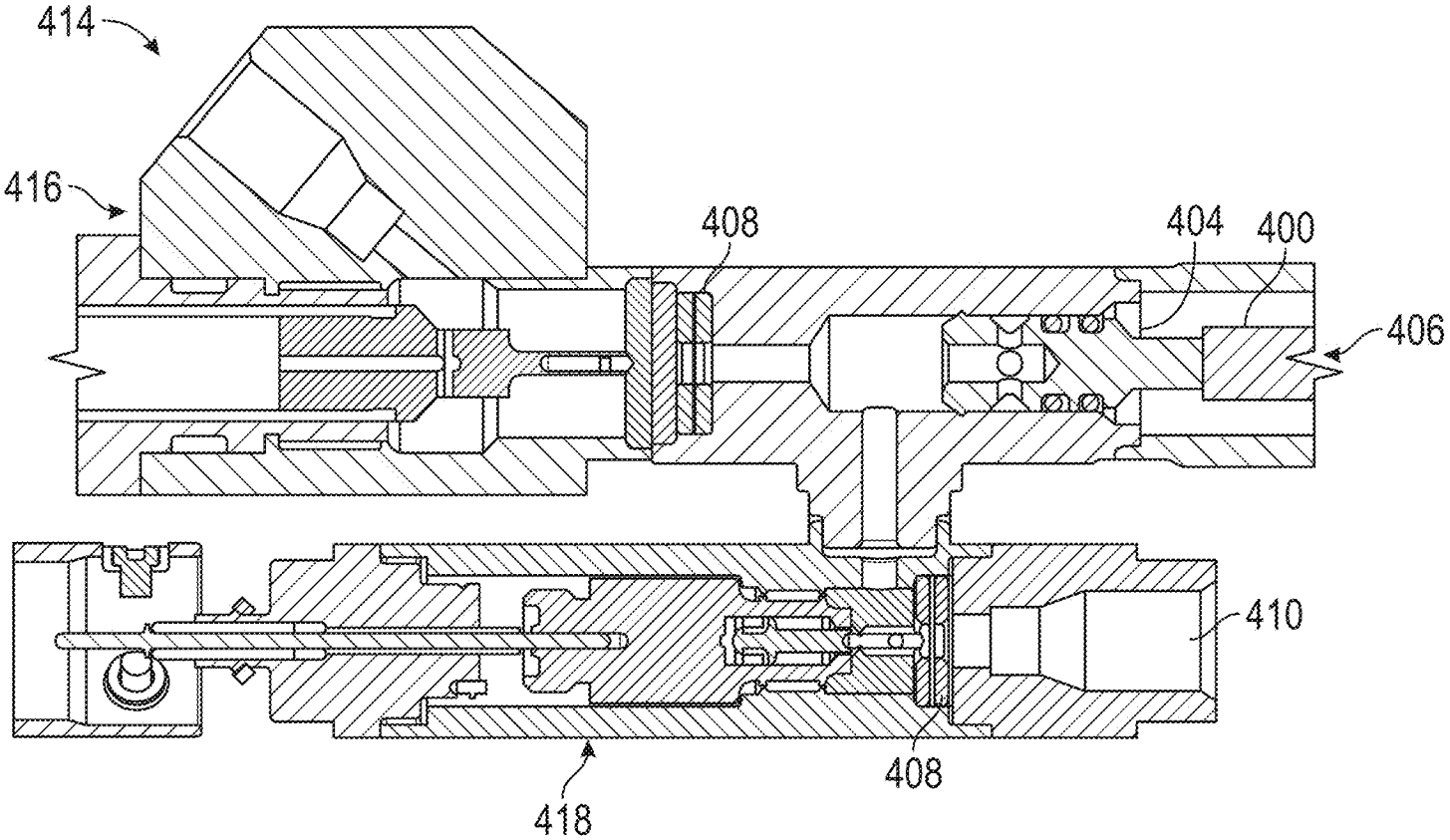
FIG. 4 shows a cross-sectional view of a trigger system, according to one or more embodiments of the present disclosure.

Turning now to FIG. 4, FIG. 4 shows a cross-sectional view of a trigger system 414. The trigger system 414 is similar in many respects to the trigger system 314 discussed above with regard to FIG. 3 Accordingly, like reference numbers have been used to indicate similar, if not identical, features. FIG. 4 differs from FIG. 3 primarily in that the piston 404 is coupled to a shaft 402 of the downhole tool 406 in the initial position, shown in FIG. 4.

As a non-limiting example, in the embodiment illustrated in FIG. 4, the pressure within the trigger pressure chambers 410 is less than the pressure within the housing 400. Rupturing the membrane 408 via either trigger 416, 418 causes a decrease in the pressure within the housing 400, which shifts the piston 404 away from the downhole tool 406, thereby actuating the downhole tool 406 via the shaft 402.

Figure 5:
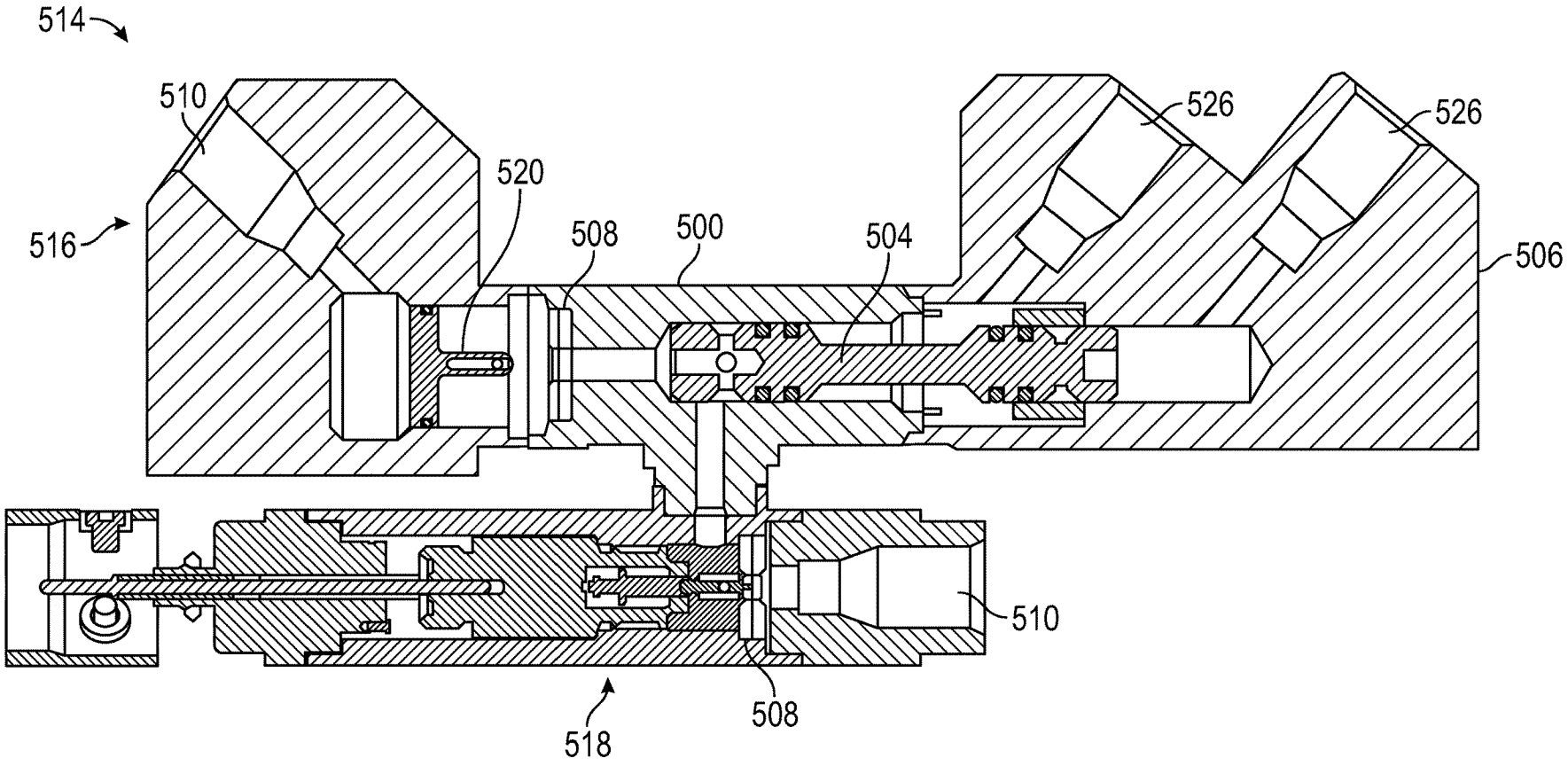
FIG. 5 shows a cross-sectional view of a trigger system, according to one or more embodiments of the present disclosure.

Turning now to FIG. 5, FIG. 5 shows a cross-sectional view of a trigger system 514. The trigger system 514 is similar in many respects to the trigger system 314 discussed above with regard to FIG. 3 Accordingly, like reference numbers have been used to indicate similar, if not identical, features. FIG. 5 differs from FIG. 3 primarily in that that the upper trigger 516 is a hydraulic trigger, where hydraulic pressure is applied to the pressure chamber 510 to shift the rupturing member 520 and that there is no flowpath between the housing 500 and the downhole tool 506 due to the seals on the piston 504. Further, the downhole tool 506 includes two devices that are actuated via the trigger system 514.

As a non-limiting example, in the embodiment illustrated in FIG. 5, the pressure within the trigger pressure chambers 510 is greater than the pressure within the housing 500. Rupturing the membrane 508 via either of the triggers 516, 518 causes an increase in the pressure within the housing 500, shifting the piston 504 towards the downhole tool 506. Shifting the piston 504 towards the downhole tool 506 increases the pressure within actuator chambers 526 of the downhole tool 506, thereby actuating the downhole tool 506.

Although the above examples illustrate trigger systems having two triggers, the invention is not thereby limited. Trigger systems may include one, three, or more triggers without departing from the scope of this invention. Further, the individual triggers may be electronic, mechanical, hydraulic, or any combination thereof. Additionally, each trigger system may actuate one, two, or more downhole tools and/or devices without departing from the scope of this invention.

As used herein, a range that includes the term between is intended to include the upper and lower limits of the range; e.g., between 50 and 150 includes both 50 and 150. Additionally, the term "approximately" includes all values within 5% of the target value; e.g., approximately 100 includes all values from 95 to 105, including 95 and 105. Further, approximately between includes all values within 5% of the target value for both the upper and lower limits; e.g., approximately between 50 and 150 includes all values from 47.5 to 157.5, including 47.5 and 157.5.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A trigger system for use with a downhole tool, the trigger system comprising:

a first housing forming a first pressure chamber at a first pressure, the first housing comprising a first membrane positioned in a wall of the first housing;

a piston disposed at least partially within the first housing, the piston shiftable from an initial position to an actuated position to actuate the downhole tool;

a first trigger comprising:

a second housing sealed against the first housing proximate the first membrane to form a second pressure chamber at a second pressure; and a first rupturing member positioned within the second housing and operable to pierce the first membrane to balance the respective pressures within the first housing and the second housing and shift the piston from the initial position to the actuated position; and a second trigger comprising:

a third housing sealed against the first housing proximate a second membrane to form a third pressure chamber at a third pressure; and a second rupturing member operable to pierce the second membrane to balance the respective pressures within the first housing and the third housing and shift the piston between the initial position and the actuated position.

2. The trigger system of claim 1, wherein the first pressure is greater than the second pressure.

3. The trigger system of claim 1, wherein the second pressure is greater than the first pressure.

4. The trigger system of claim 1, wherein the piston is configured to move axially along a piston axis, the first rupturing member is configured to move axially along a first axis coaxial with the piston axis, and the second rupturing member is configured to move axially along a second axis laterally offset from the piston axis.

5. The trigger system of claim 1, wherein at least one of the first rupturing member or the second rupturing member is operable via hydraulic pressure.

6. The trigger system of claim 1, wherein at least one of the first rupturing member or the second rupturing member is operable via a mechanical actuator.

7. The trigger system of claim 1, wherein at least one of the first rupturing member or the second rupturing member is operable via an electronic actuator.

8. The trigger system of claim 1, wherein the second pressure is approximately equal to the third pressure.

9. The trigger system of claim 1, wherein the first trigger and the second trigger are independent of each other.

10. The trigger system of claim 1, wherein the trigger system further comprises a third trigger comprising:

a fourth housing sealed against the first housing proximate a third membrane to form a fourth pressure chamber at a fourth pressure; and a third rupturing member operable to pierce the third membrane to balance the respective pressures within the first housing and the fourth housing and shift the piston between the initial position and the actuated position.

11. The trigger system of claim 10, wherein the second pressure, the third pressure, and the fourth pressure are approximately equal to each other.

12. The trigger system of claim 10, wherein the first trigger, the second trigger, and the third trigger are independent of each other.

13. A completion system comprising:

a well string;

a downhole tool operatively coupled to the well string; and a trigger system operatively coupled to the downhole tool, the trigger system comprising:

a first housing forming a first pressure chamber at a first pressure, the first housing comprising a first membrane positioned in a wall of the first housing;

a piston disposed at least partially within the first housing, the piston shiftable from an initial position to an actuated position to actuate the downhole tool;

a first trigger comprising:

a second housing sealed against the first housing proximate the first membrane to form a second pressure chamber at a second pressure; and a first rupturing member positioned within the second housing and operable to pierce the first membrane to balance the respective pressures within the first housing and the second housing and shift the piston from the initial position to the actuated position; and a second trigger comprising:

a third housing sealed against the first housing proximate a second membrane to form a third pressure chamber at a third pressure; and a second rupturing member operable to pierce the second membrane to balance the respective pressures within the first housing and the third housing and shift the piston between the initial position and the actuated position.

14. The completion system of claim 13, wherein the downhole tool comprises at least one of an isolation valve or a packer.

15. The completion system of claim 13, wherein the piston is configured to move axially along a piston axis, the first rupturing member is configured to move axially along a first axis coaxial with the piston axis, and the second rupturing member is configured to move axially along a second axis laterally offset from the piston axis.

16. The completion system of claim 13, wherein at least one of the first rupturing member or the second rupturing member is operable via hydraulic pressure.

17. The completion system of claim 13, wherein at least one of the first rupturing member or the second rupturing member is operable via a mechanical actuator.

18. The completion system of claim 13, wherein at least one of the first rupturing member or the second rupturing member is operable via an electronic actuator.

19. A method of producing a well comprising:

running a well string comprising a downhole tool and a trigger system into the well;

providing a first membrane separating a first housing of the trigger system at a first pressure and a second housing of the trigger system at a second pressure, the first membrane rupturable via piercing by a first rupturing member to balance the respective pressures in the first housing and the second housing to shift a piston of the trigger system from an initial position to an actuated position, wherein the piston and the first membrane are disposed in the first housing and the first rupturing member is disposed in the second housing;

providing a second membrane separating the first housing of the trigger system at the first pressure and a third housing of the trigger system at a third pressure, the second membrane rupturable via piercing by a second rupturing member to balance the respective pressures in the first housing and the third housing to shift the piston between the initial position and the actuated position; and actuating the downhole tool via rupturing of the first membrane or rupturing of the second membrane.

20. The method of claim 19, wherein the piston is configured to move axially along a piston axis, the first rupturing member is configured to move axially along a first axis coaxial with the piston axis, and the second rupturing member is configured to move axially along a second axis laterally offset from the piston axis.

* * * * *